US006164002A

United States Patent [19]

Troncoso

[11] Patent Number: 6,164,002

[45] Date of Patent: Dec. 26, 2000

[54] GUN HAVING A RAPID FIRE TRIGGER ASSEMBLY AND THE ASSEMBLY THEREFOR

[76] Inventor: Vincent F. Troncoso, 14090-6100 Rd., Montrose, Colo. 81401

[21] Appl. No.: 09/228,960

[22] Filed: Jan. 12, 1999

[51] Int. Cl.[7] ..... F41A 19/00

[52] U.S. Cl. ..... 42/69.01

[58] Field of Search ..... 42/69.01, 69.02, 42/69.03; 89/140, 27.3

[56] References Cited

U.S. PATENT DOCUMENTS

| | | | |
|---|---|---|---|
| 1,513,654 | 10/1924 | Thompson | 42/69.01 |
| 1,837,093 | 12/1931 | Andrews | 42/69.01 |
| 2,589,227 | 3/1952 | Colley | 42/69.01 |
| 2,920,413 | 1/1960 | Marhefka | 42/69.01 |
| 3,031,786 | 5/1962 | Swan | 42/69.01 |
| 3,184,875 | 5/1965 | Klebe | 42/69.01 |
| 4,553,347 | 11/1985 | Jackson | 42/69.01 |
| 4,685,379 | 8/1987 | Troncoso | 42/69.01 |
| 4,803,910 | 2/1989 | Troncoso | 89/27.3 |
| 5,074,190 | 12/1991 | Troncoso | 42/69.01 |
| 5,780,762 | 7/1998 | Kobayashi | 89/140 |

FOREIGN PATENT DOCUMENTS

| | | | |
|---|---|---|---|
| 518741 | 2/1931 | Germany | 42/69.01 |
| 3237329 | 4/1984 | Germany | 42/69.01 |
| 4125148 | 2/1993 | Germany . | |

*Primary Examiner*—Darren W. Ark
*Attorney, Agent, or Firm*—Donald E. Nist

[57] ABSTRACT

The gun of the present invention has a rapid fire trigger assembly. The gun includes a main body with a trigger rotatably secured therein for operating the firing mechanism of the gun. The trigger has a lower portion depending below the main body into a trigger housing or guard below the main body. The housing includes an upper portion connected to the underside of the main body of the gun and a lower horizontal bar spaced therebelow and defining therewith a finger space. The trigger is spring biased into a forward nonfiring position and is rotatable into a rear firing position. A detachable and adjustable rapid fire assembly is attached to the bar of the housing and includes a lever projecting up into the finger space in front of and spaced from the trigger, a connector with its front end pivotally secured to the lower end of the lever and a rear end adapted to contact the first trigger. The middle portion of the connector is rigidly secured to a retainer band slideably secured to the bar for movement between forward and rearward positions. An elongated pivot block is adjustably secured to the bar in front of the lever and projects up into the path of the lever, contacting the lower portion thereof so that when the lever is pivoted forwardly said connector rear end is driven rearwardly into the trigger to cause the trigger to fire the gun.

6 Claims, 1 Drawing Sheet

GUN HAVING A RAPID FIRE TRIGGER ASSEMBLY AND THE ASSEMBLY THEREFOR

BACKGROUND OF THE INVENTION

1. Field of the Invention

The present invention generally relates to weapons and more particularly relates to an gun which has a rapid fire trigger assembly, and the rapid fire trigger assembly for said gun.

2. Prior Art

Various devices have been invented to increase the speed which a semi-automatic gun can be fired. Most such devices are complicated, expensive, difficult to install on a gun and to operate and have a limited lifespan. Moreover, most such devices are expensive and bulky and hard to repair and to adjust for optimal efficiency.

Accordingly, it would be desireable to be able to provide a simple, inexpensive, durable device for installation on a semi-automatic gun which would increase appreciably the speed at which the gun could be conveniently fired. Such device should be easy to install and repair and, moreover, should be easy to adjust to customize the gun to the needs of the gunner utilizing such gun.

SUMMARY OF THE PRESENT INVENTION

The improved gun and trigger assembly of the present invention satisfy all the foregoing needs. Thus, the present invention is directed to a gun which has an improved capability of being fired rapidly and with total control, and to a novel trigger assembly which effects the desired increase in rapid firing capability. The assembly is adaptable for use on a wide variety of semi-automatic weapons, such as rifles and pistols, and is easily installed and repaired, easily adjusted to the individual needs of the gunner, is inexpensive and durable and is of small unobtrusive size. It is suitable for use by both novice and experienced women and men gunners.

The gun includes a main body having a firing mechanism and a trigger rotatably secured in the main body for operating the firing mechanism. The trigger depends below the main body into the finger space defined by a trigger guard in the form of a housing having an upper portion connected to the underside of the main body and a lower generally horizontal bar spaced below the upper portion and connected thereto. The trigger is spring-biased into a resting forward non-firing position but can be urged rearwardly into a firing position.

The gun includes a detachable and readily adjustable rapid fire assembly which comprises, in combination, a lever projecting up from the bar into the space in the housing and forward of the trigger. The lower end of the lever is rotatably secured to the front end of a connector in the form of a flat plate. The rear end of the connector is adapted to be positioned near the lower end of the trigger and to activate it when pushed into it.

The middle portion of the connector is rigidly secured to a retainer band which exposes the opposite ends of the connector. The retainer band is slideably received over the bar of the housing so that the connector can be slid back and forth on the bar. The assembly also includes an elongated pivot block adjustably secured to the bar in front of the lever, projecting into the space and adapted to have the lever bear thereagainst when the lever is rotate forwardly in the housing space. This results in driving the rear end of the connector into the trigger and moving it rearwardly to fire the gun.

The position of the block and lever can be adjusted so that slack in the trigger is taken up before a gunner's finger is inserted between the trigger and lever. Therefore the gun can be rapidly sequentially fired by slight forward and backward movement of the gun finger between the trigger and lever. This movement can be effected or facilitated by the spring-biasing action of the trigger upon firing the gun.

Preferably, the rear end of the connector has a raised or upturned lip to accommodate triggers of different configurations. Moreover, the upper portion of the lever is preferably encased in an elastomeric substance for increased comfort and cushioning during use of the gun. In as much as all components of the assembly are relatively small and are attached to the housing, they do not interfere with proper use, storage and carrying of the gun and do not become misaligned. The assembly components can be made of any one or a number of suitable durable stable materials.

Various other features of the improved gun and assembly of the present invention are set forth in the following detailed description and accompanying drawings.

DRAWINGS OF THE PREFERRED EMBODIMENT OF THE PRESENT INVENTION

Figure 1:
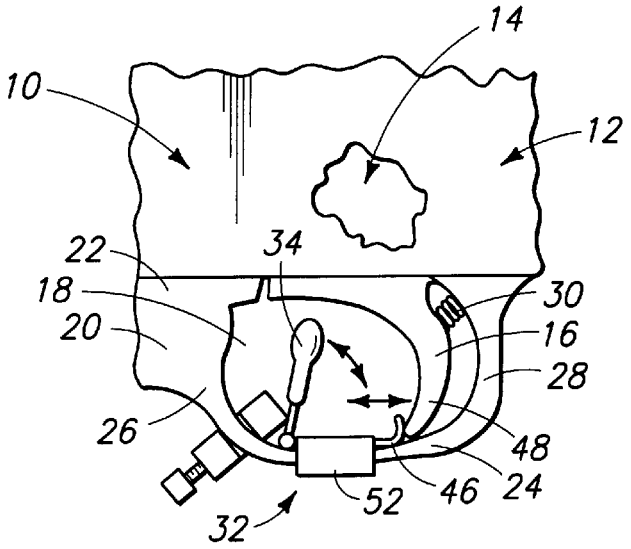
FIG. 1 is a schematic fragmentary side elevation, partly broken away, of a preferred embodiment of the improved gun and assembly of the present invention, showing the gun trigger in the spring-biased forward non-firing position.
Figure 2:
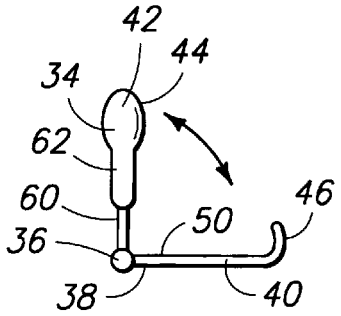
FIG. 2 is an enlarged schematic side elevation of the lever of the assembly and gun of FIG. 1, shown pivotably connected to the connector of the assembly and gun.
Figure 3:
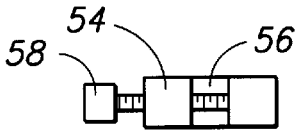
FIG. 3 is an enlarged schematic side elevation of the pivot block of the assembly and gun of FIG. 1.
Figure 4:
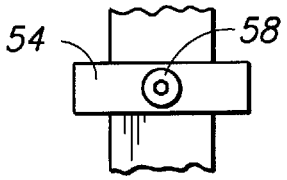
FIG. 4 is an enlarged schematic front elevation of the pivot block of FIG. 3, shown clamped to the bar of the housing of the gun of FIG. 1.
Figure 5:
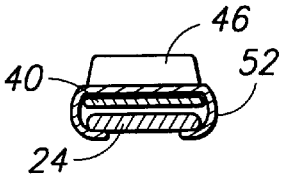
Figure 6:
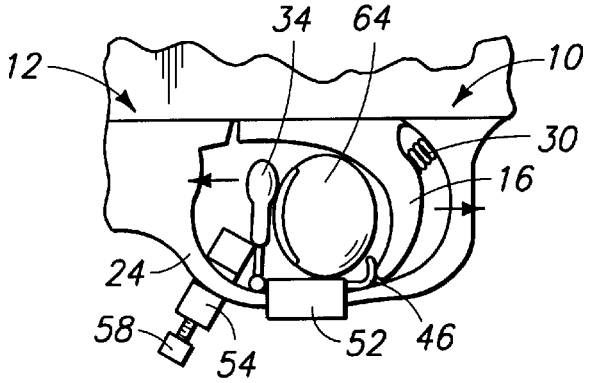

FIG. 5 is an enlarged schematic transverse cross-section of the assembled retainer band, connector and housing bar of the gun of FIG. 1, viewed from the front thereof and showing the rear end of the connector rising above the retainer band; and, FIG. 6 is a schematic side elevation of the gun and assembly of FIG. 1, shown with a gunner's finger in place between the lever and trigger and with the trigger forced rearwardly toward a firing position.

DETAILED DESCRIPTION OF THE PREFERRED EMBODIMENT OF THE INVENTION

FIGS. 1–6:

Now referring more particularly to FIGS. 1–6 of the drawings, a preferred embodiment of the improved rapid-firing gun and the rapid fire assembly for the same is set forth schematically therein.

Thus, gun 10 is shown in fragmentary view and includes a main body 12 which includes a conventional firing mechanism 14 and a trigger 16, the latter being rotatably secured (not shown) in main body 12 to operate firing mechanism 14. Trigger 16 depends below main body 12, as shown in FIG. 1, into a space 18 defined by a trigger guard or housing 20, the upper portion 22 of which is secured to the underside of main body 12. Housing 20 also includes a generally horizontal bar 24 spaced below portion 22 and connected thereto by bars 26 and 28 which are integral with portion 22 and bar 24. Trigger 16 is biased forward in space 18 by a spring 30 to a non-firing position.

Gun 10 includes a rapid fire assembly 32 which comprises, in combination, an upstanding lever 34, the lower end 36 of which is pivotably rotatably connected to the front end 38 of connector plate 40 and the upper end 42 of which is preferably sheathed in an elastomer 44 such as natural or synthetic rubber or plastic. The rear end 46 of connector plate 40 is preferably curved upwardly, as shown in FIG. 1, to intercept and accommodate the lower end 48 of trigger 16. The middle portion 50 of connector plate 40 is rigidly secured to a retainer band 52 which laps over portion 50 and clamps around bar 24 in secure but sliding engagement therewith. Front end 38 and rear end 46 of connector plate 40 are not enclosed by retainer band 52. Rapid fire assembly 32 also includes a pivot block 54 which preferably is elongated and has a side slot 56 therein within which bar 24 is releasably held by a set screw 58. Pivot block 54 preferably cants backward toward the lower portion 60 of lever 34, as shown in FIG. 1,and acts as a stop point during forward movement rotation of the upper portion 62 of lever 34. Pivot block 54 is adjustably positioned on bar 24 in front of lever 34 and extends upwardly into space 18.

In order to adjust assembly 32 for optimal rapid firing of gun 10, the slack in trigger 16 is taken up by pulling it backwardly until resistance is met short of dry firing gun 10. Block 54 is then slid rearwardly on bar 24 until it contacts lower portion 60 of lever 34 when the latter is in an about upright position. The gunner's trigger finger 64 is then pushed into place on trigger 16, being wedged behind lever 34, as shown in FIG. 6. Slight rearward movement of finger 64 will now fire gun 20 and slight forward movement of finger 64 will again fire gun 20 as finger 64 rotates upper portion 62 of lever 34 forwardly, thus driving rear end 46 of plate 40 into trigger 16 as trigger 16 is returning by spring 30 to the forward non-firing position.

Thus, assembly 32 converts gun into a rapid firing weapon capable of firing up to 600 times or more a minute with minimal travel of finger 64 while engaged with trigger 16. The degree of sensitivity to firing can be easily controlled by the gunner by adjustment of the position of pivot block 54, as the size of finger 64 and the individual firing requirements of the gunner dictate.

Lever 34, connector 40, retainer band 52 and pivot block 54 can be made of durable metal such as stainless steel, aluminum, carbon steel or the like so as to be serviceable over a long period of time in all types of weather. Since these components are small and mainly fit within space 18 of housing 20, they are protected against bumping and misalignment during use, travel and storage of gun 10.

It will be understood that rapid fire assembly 32 can be sold separately from gun 10 and that assembly 32 forms part of the present invention. It will also be understood that rear end 46 of connector 40 can be flat instead of curved and that connector 40 need not be a flat plate, but can be a rod, etc. It will be further understood that pivot block 54 can be in any desired configuration and can be secured to bar 24 by any suitable means. In addition, retainer band 52 also can be of any suitable configuration which holds connector 40 and moves it along bar 24 as lever 34 rotates forwardly and rearwardly.

Various other modifications, changes, alterations and additions can be made in the improved gun and assembly of the present invention, their components and parameters. All such modifications, changes, alterations and additions as are within the scope of the appended claims form part of the present invention.

What is claimed is:

1. A detachable and adjustable rapid fire assembly for a gun having a main body and a trigger pivotably secured thereto and depending therefrom into a trigger finger space defined by a trigger housing having an upper portion connected to said main body and a bar spaced below said upper housing portion, said trigger having a lower portion being spring biased into a forward non-firing position, said assembly including, in combination:

a) a lever having an upper portion and an opposite lower portion, said lever being adapted to project upwardly into said trigger finger space from said bar forward of said trigger, b) a generally flat connector having a front end pivotally secured to said lower portion of said lever for movement of said lever between a forward and a rearward position, said connector having a rear end adapted to releasably contact the lower portion of said trigger to fire said gun, c) a retainer band disposed over and rigidly retaining a middle portion of said connector but exposing the front and rear ends of said connector, said retainer band being adapted to be slideably secured around said bar for adjustable positioning of said connector between forward and rearward positions within said housing forward of said trigger, and d) an elongated pivot block adapted to be adjustably slideably secured to said bar in front of said lever and project up into said space to bear against said lever when said lever is pivoted forward to drive said connector rearwardly to contact said trigger and effect firing of said gun, whereby a gunner's trigger finger can be rapidly moved between and alternately against said trigger and said lever to effect rapid sequential firing of said gun.

2. The assembly of claim 1 wherein said rear end of said connector has a raised lip for engaging said lower portion of said trigger to fire said gun and wherein an upper portion of said pivot block is canted rearwardly to engage the lower portion of said trigger lever at an angle from the vertical.

3. The assembly of claim 2 wherein the upper portion of said lever is sheathed in an elastomer and wherein said pivot block is releasably secureable to said bar by a set screw.

4. A gun having a rapid fire trigger assembly, said gun including, in combination:

a) a main body which has a firing mechanism disposed therein and a trigger rotatably secured in said main body for operating said firing mechanism, said trigger having a lower portion depending below said main body;

b) a trigger housing secured to an underside of said gun main body and including an upper portion and a generally horizontal lower bar spaced below said upper portion and defining therewith a trigger finger space into which said lower portion of said trigger depends for forward and backward movement therein between a spring-biased forward non-firing position and a rearward firing position; and, c) a detachable and adjustable rapid fire assembly comprising, in combination, i. a lever having an upper portion and an opposite lower portion, said lever projecting upwardly into said trigger finger space from said lower bar forward of said trigger lower portion, ii. a connector having a front end pivotally secured to said lower portion of said lever for movement of said lever between a forward and a rearward position, said connector also having a rear end adapted to contact the lower portion of said trigger, iii. a retainer band rigidly secured around a middle portion of said connector but exposing said front and rear ends of said connector, said band being slideably secured to said bar of said housing for adjustable positioning of said connector between forward and rearward positions, and iv. an elongated pivot block adjustably secured to said bar and projecting up into said trigger finger space in front of said lever and adapted to bear against said lever when said lever is pivoted forward to drive said connector rear end rearwardly into said trigger to effect firing of said gun, whereby a gunner's trigger finger can be rapidly moved between said trigger and said lever to alternately bias said trigger rearwardly and said lever forwardly to effect rapid sequential firing of said gun.

5. The gun of claim 4 wherein said rear end of said connector has a raised lip for engaging said lower portion of said trigger to fire said gun and wherein an upper portion of said pivot block is canted rearwardly to engage the lower portion of said lever at an angle from the vertical.

6. The gun of claim 5 wherein the upper portion of said lever is sheathed in an elastomer and wherein said pivot block is releasably secured to said bar by a set screw.

* * * * *